US011504603B2

(12) United States Patent
Jeong et al.

(10) Patent No.: US 11,504,603 B2
(45) Date of Patent: Nov. 22, 2022

(54) TRAIN-TYPE GAMING APPARATUS

(71) Applicant: ANDAMIRO CO., LTD., Gyeonggi-do (KR)

(72) Inventors: Ku In Jeong, Gyeonggi-do (KR); Jeong Min Lee, Gyeonggi-do (KR)

(73) Assignee: ANDAMIRO CO., LTD., Gyeonggi-Do (KR)

( * ) Notice: Subject to any disclaimer, the term of this patent is extended or adjusted under 35 U.S.C. 154(b) by 69 days.

(21) Appl. No.: 17/109,211

(22) Filed: Dec. 2, 2020

(65) Prior Publication Data

US 2022/0168627 A1 Jun. 2, 2022

(51) Int. Cl.

| | |
|---|---|
| ***A63F 7/30*** | (2006.01) |
| ***A63F 7/28*** | (2006.01) |
| ***A63F 7/02*** | (2006.01) |

(52) U.S. Cl.

CPC ..... *A63F 7/307* (2013.01); *A63F 7/02* (2013.01); *A63F 7/28* (2013.01)

(58) Field of Classification Search

CPC .... A63F 7/307; A63F 7/02; A63F 7/28; A63F 9/0243; A63F 2007/3666; A63F 7/3622; A63F 7/027; A63F 2009/2402; A63F 2009/2444; A63F 2009/2482

See application file for complete search history.

(56) References Cited

U.S. PATENT DOCUMENTS

| | | | | | |
|---|---|---|---|---|---|
| 1,554,165 | A * | 9/1925 | McElroy | A63F 7/00 | 463/67 |
| 1,872,204 | A * | 8/1932 | Wily | A63F 7/3622 | 104/63 |
| 2,732,958 | A * | 1/1956 | Bonanno | A63H 19/00 | 198/359 |
| 2,960,336 | A * | 11/1960 | Guensch | A63F 7/00 | 273/120 R |
| 4,108,438 | A * | 8/1978 | Rackman | A63F 7/02 | 273/284 |
| 4,189,864 | A | 2/1980 | Saito | | |
| 5,342,018 | A | 8/1994 | Wu | | |
| 6,062,942 | A | 5/2000 | Ogihara | | |
| 6,209,868 | B1 * | 4/2001 | Norton | G07F 17/3295 | 273/123 R |
| 2005/0193919 | A1 | 9/2005 | Murray | | |

* cited by examiner

*Primary Examiner* — Michael D Dennis

(74) *Attorney, Agent, or Firm* — Stuart H. Mayer; Mayer & Williams PC

(57) ABSTRACT

Disclosed is the game apparatus using a train device constituted by cars of different sizes. The play ball lowered along the lane assembly may enter any one of the cars. Depending on the car into which the play ball enters, a predetermined reward may be provided to the player. The play ball entering the car deviates through the opening and rises through the elevating device. The raised play ball may be waited to descend again through the lane assembly.

12 Claims, 11 Drawing Sheets

[FIG. 1]
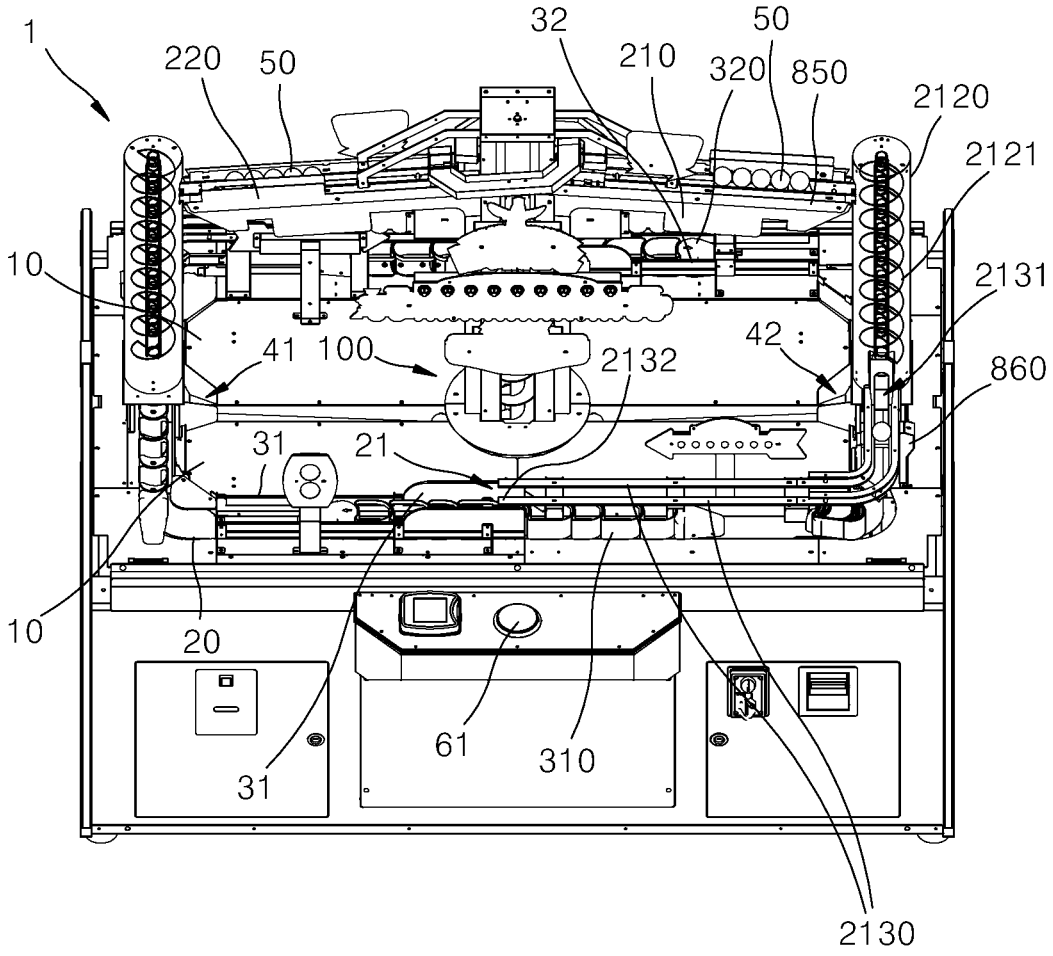

[FIG. 2]
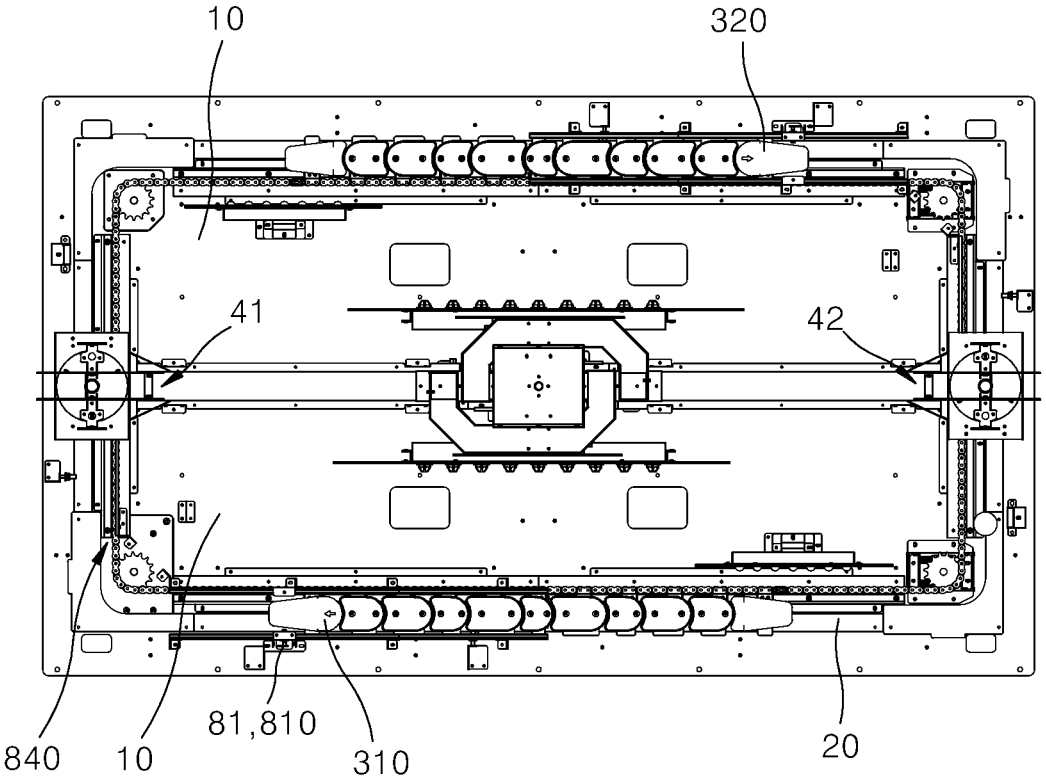

[FIG. 3]
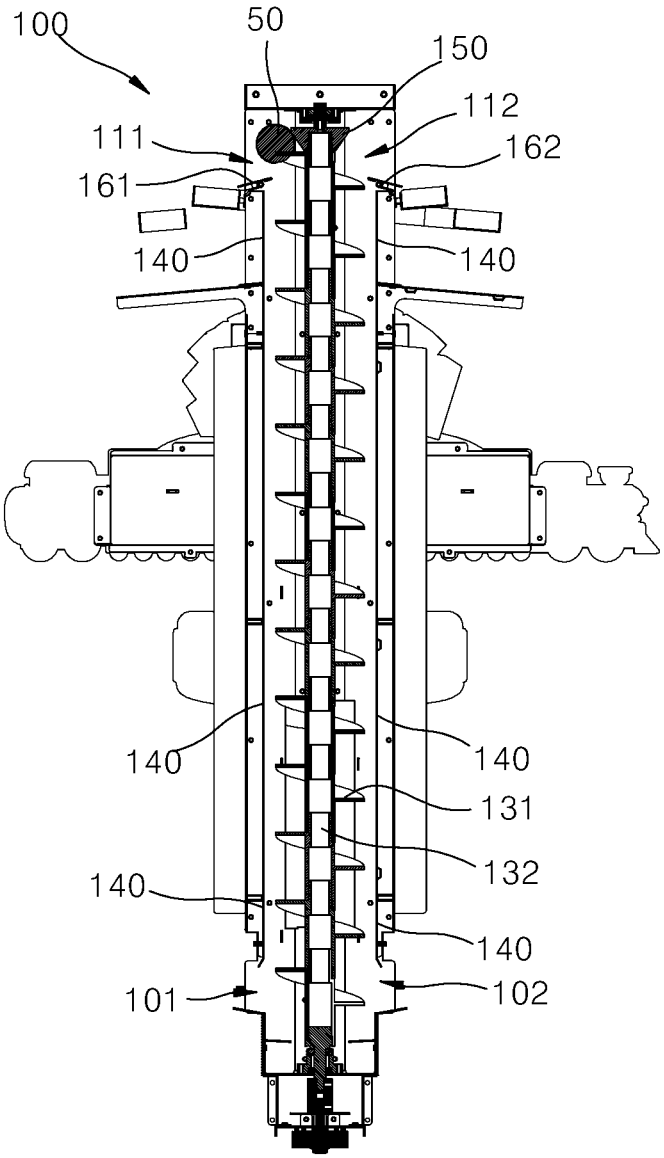

[FIG. 4]
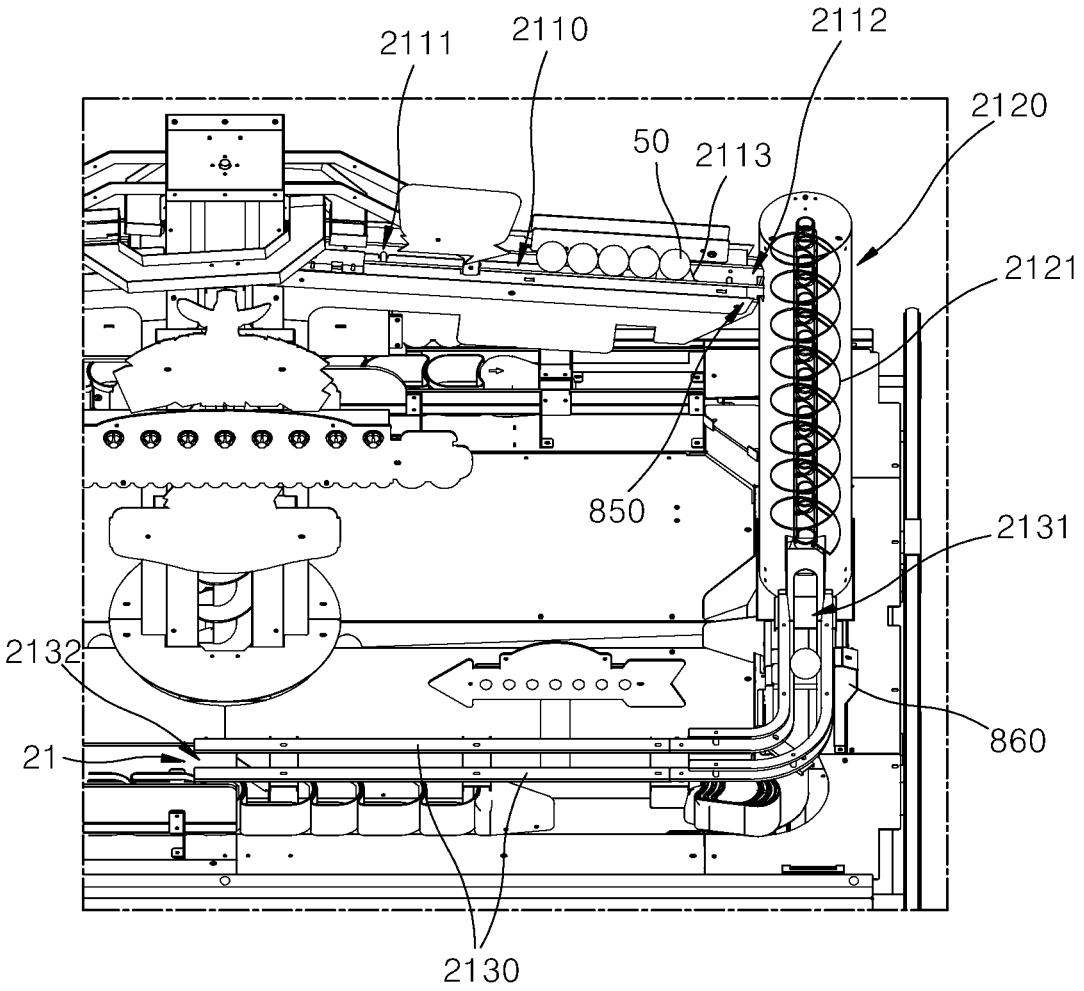

[FIG. 5]
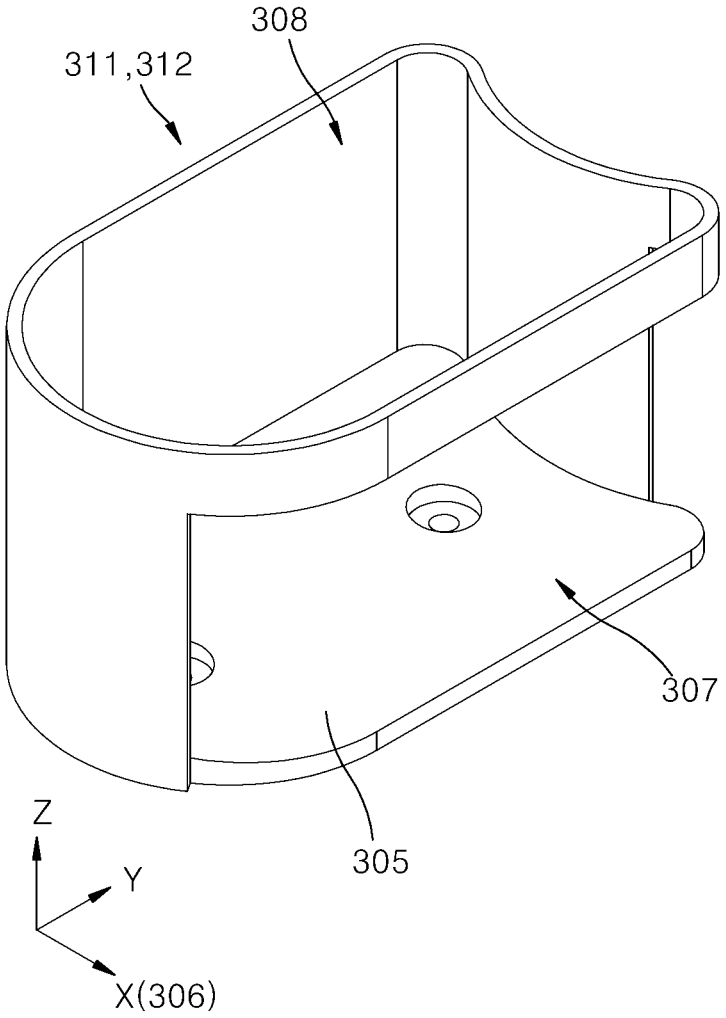

[FIG. 6]
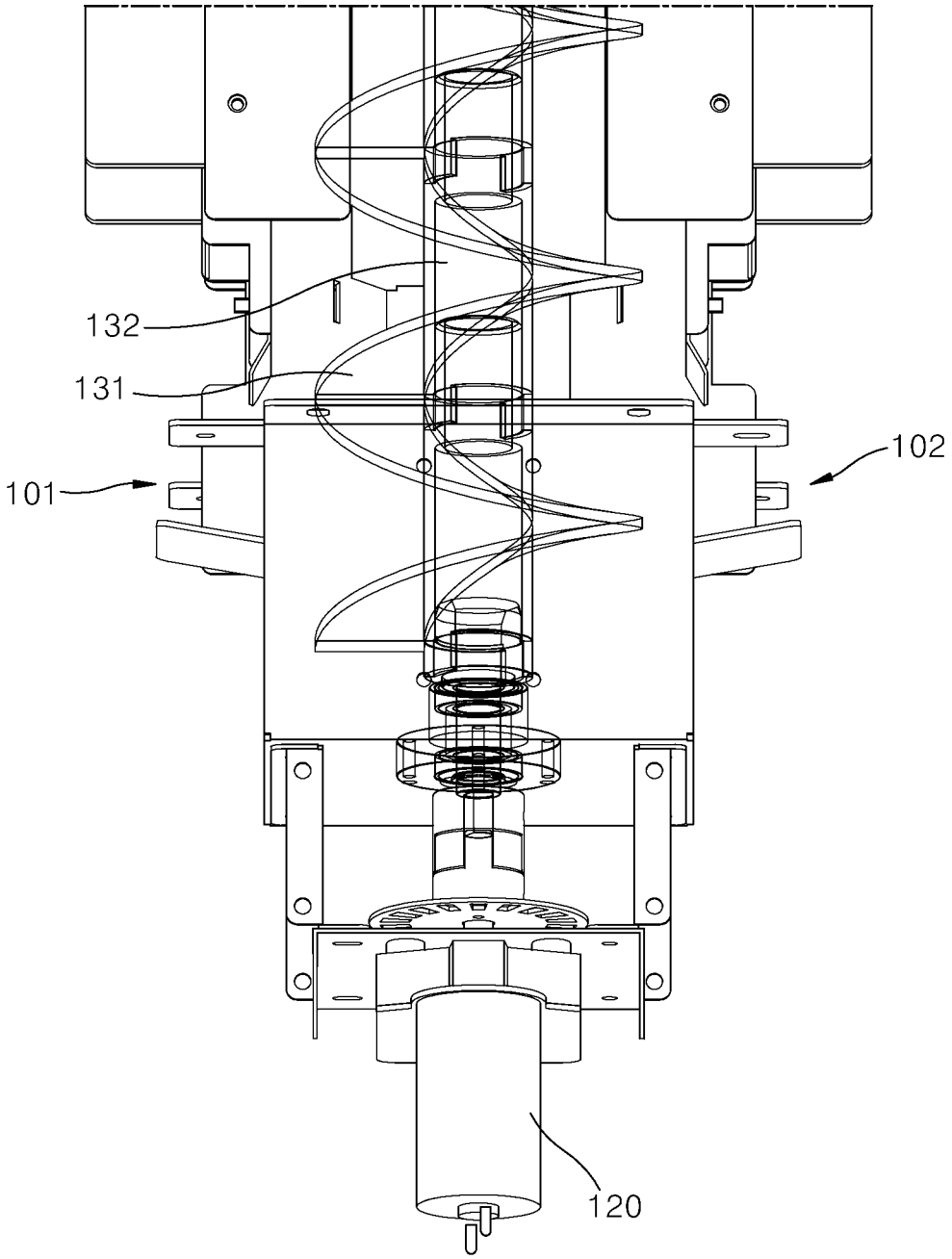

[FIG. 7]
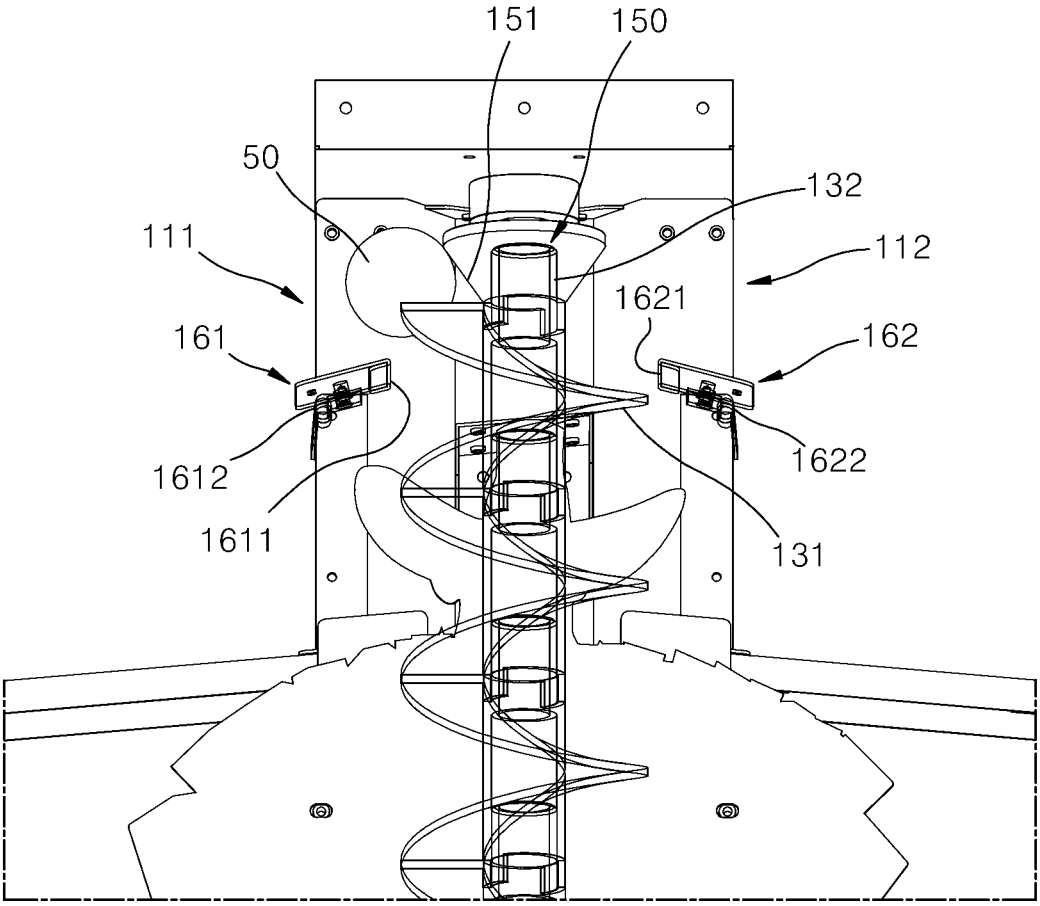

[FIG. 8]
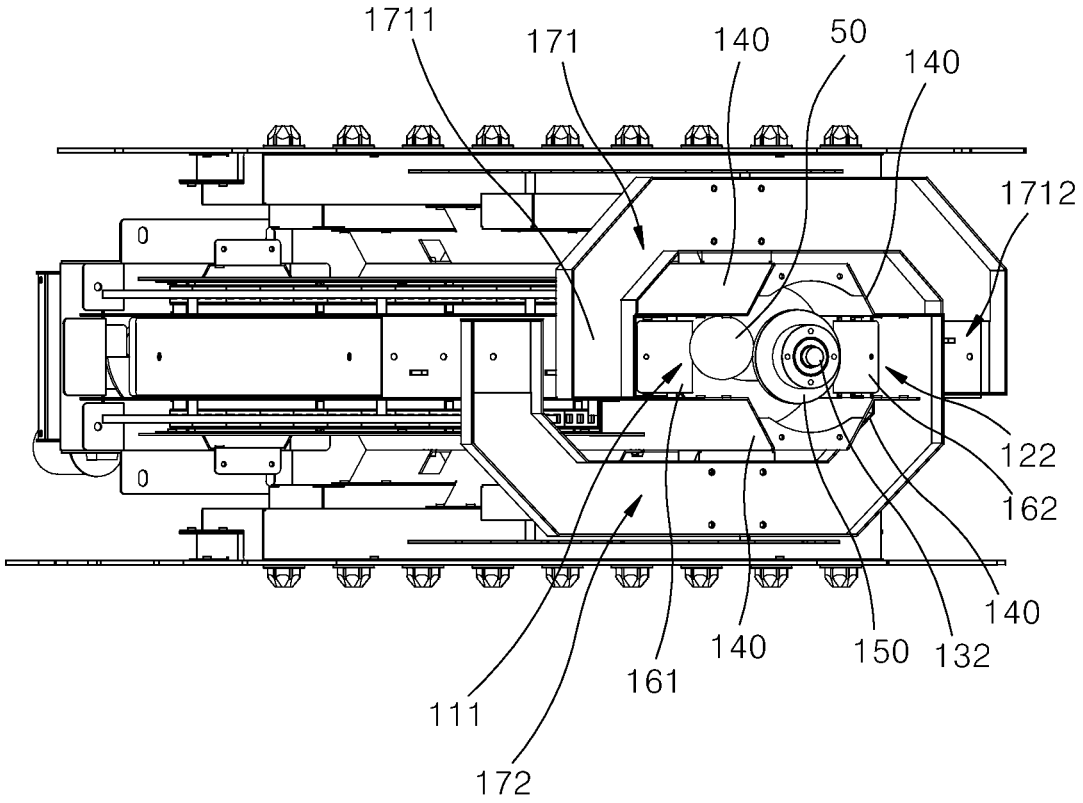
[FIG. 9]
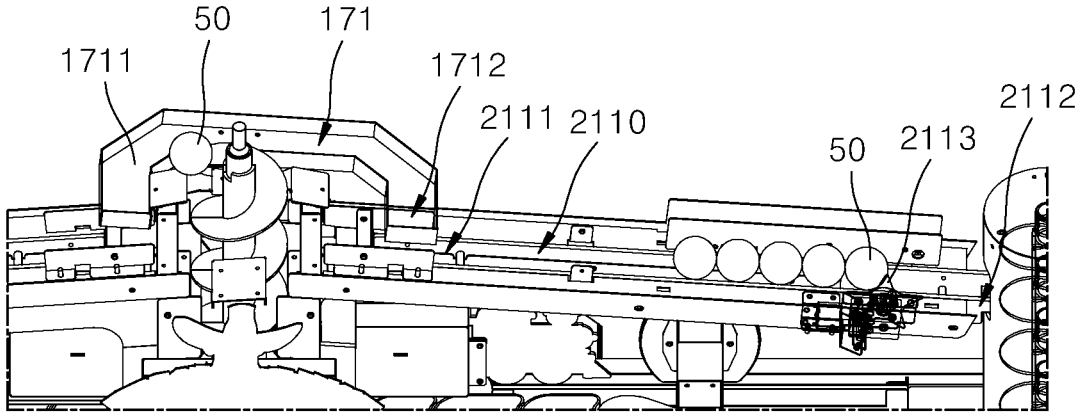

[FIG. 10]
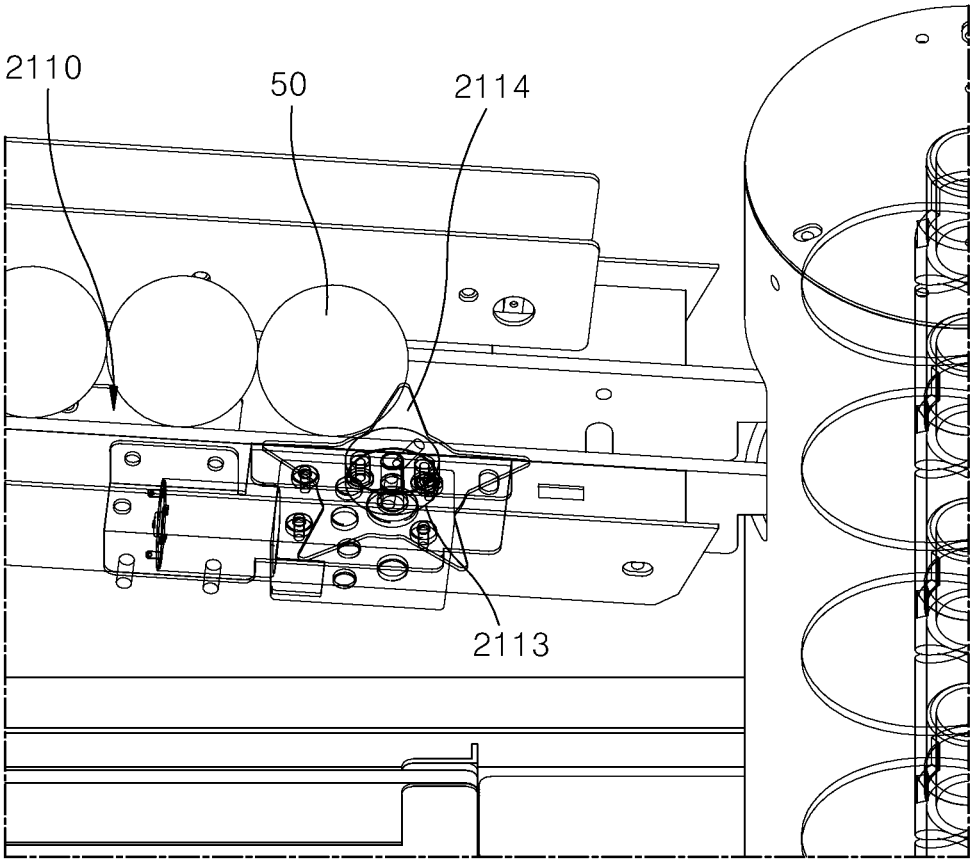
[FIG. 11]
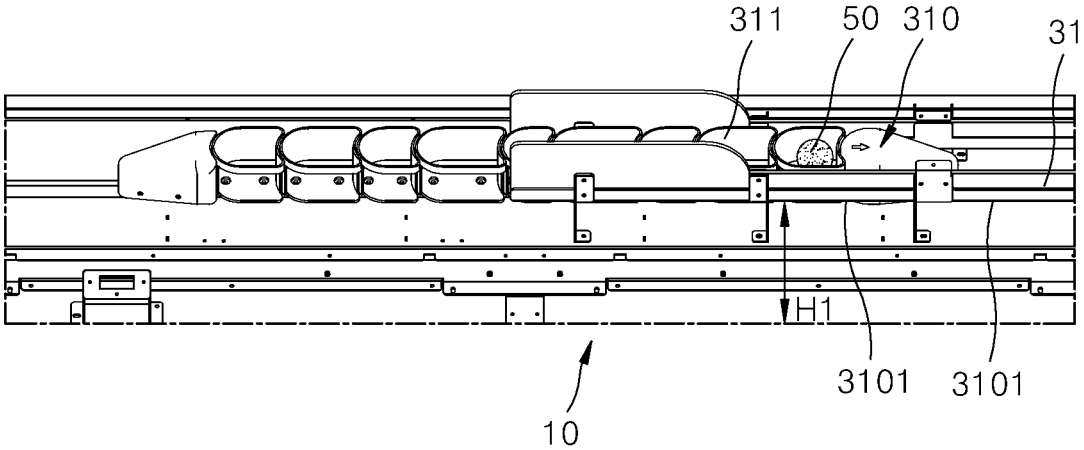

[FIG. 12]
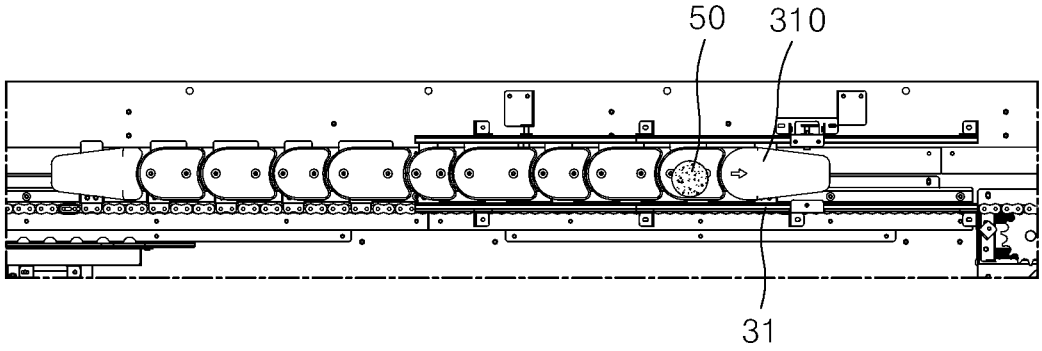
[FIG. 13]
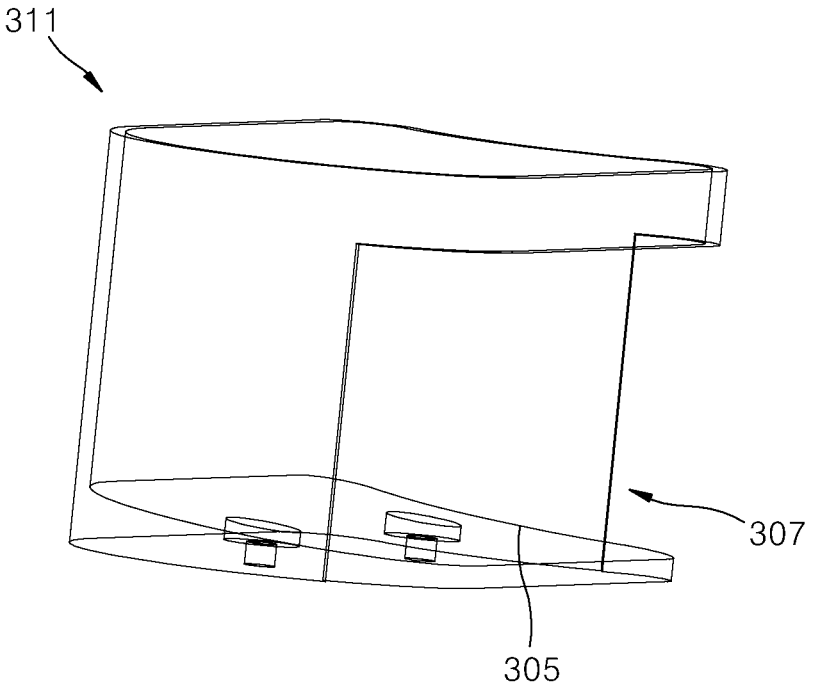

[FIG. 14]
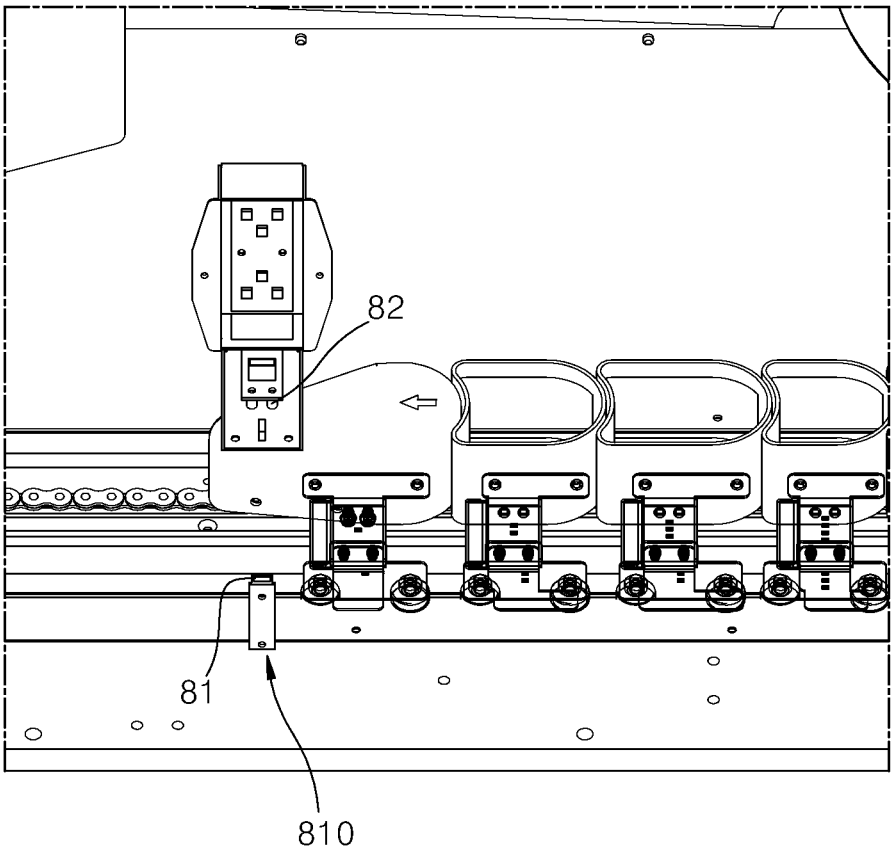
[FIG. 15]
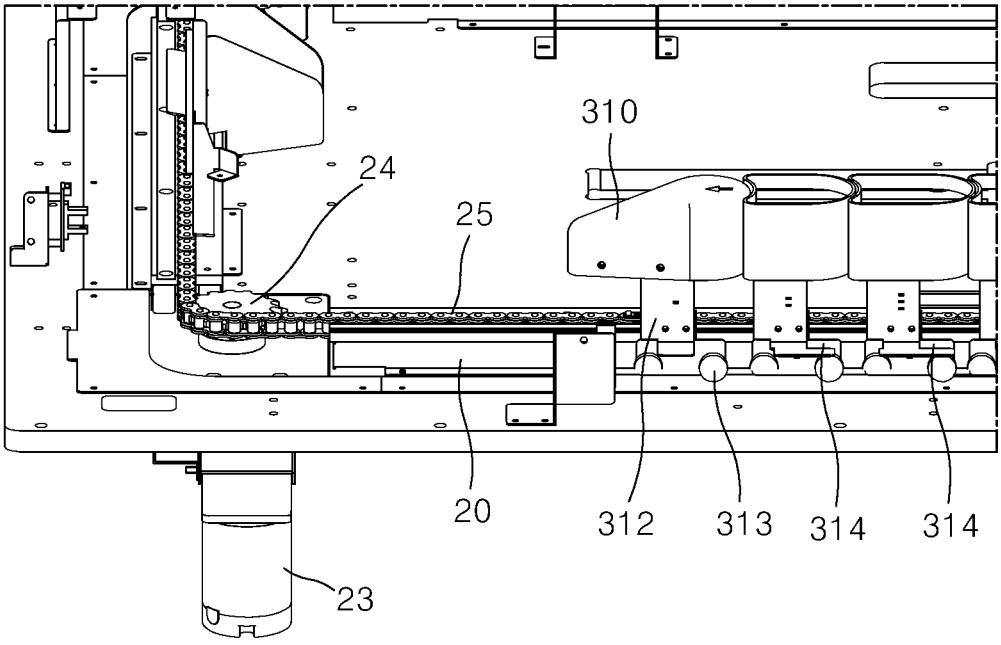

TRAIN-TYPE GAMING APPARATUS

TECHNICAL FIELD

The present invention relates to an arcade game machine, and more particularly to a game machine in which a game scenario is played by using a play ball and a train device using a track.

BACKGROUND

The present invention relates to a train-type game apparatus, and U.S. Patent Registration Nos. U.S. Pat. Nos. 5,342,018, 6,062,942, and 4,189,864, and U.S. Patent Application Publication No. US20050193919 are present in this field.

According to the above related art, a train and a track, on which the train may move, are provided, and a structure in which the tracks are inclined to rise or fall with respect to a direction in which the train proceeds is disclosed.

However, since the train-type game apparatuses according to the related art do not include own game scenarios, and thus users using the game apparatuses should create and use own game scenarios to have fun from the games.

SUMMARY

The present invention provides a game apparatus using a train device and a play ball, which has own game scenario and a structure that allows two players to play games independently.

An embodiment of the present invention provides a game apparatus including: a base floor; an elevating device installed at one point of the base floor; a closed track disposed in a form of surrounding the elevating device; a first lane assembly configured to provide a movement path of a play ball provided from a first exit disposed at an upper end of the elevating device; a first train device configured to move in one direction along the track and comprising a first set of cars, wherein the upper side of each of the cars is open such that an arbitrary play ball enters into the each of the cars, and one side of the each of the cars is open towards the inner space of the track such that the arbitrary play ball exits from the each of the cars towards the inner space of the track, the bottom surfaces of the each of the cars is inclined in the direction of the inner space, and a first lower end of the first lane assembly is disposed at a location such that the play ball falling from the first lower end passes through a first point over the track; a first guard rail disposed to extend along the track in the inner space such that a first play ball placed on a first bottom surface of any one of the first set of cars is not separated from the first bottom surface, and a first opening disposed next to a first end, among both ends of the first guard rail, in a direction in which the first train device moves forwards, and configured to allow the first play ball to be separated from the first bottom surface and fall to the base floor. Also, the base floor includes a first slope configured to provide a path, in which the first play ball falling through the first opening rolls to a first entrance disposed at a lower end of the elevating device, and the elevating device raises the first play ball entering through the first entrance, and send out the first play ball through the first exit.

In an embodiment, the first lane assembly may include: an inclined first upper lane configured to provide an upper movement path of the first play ball;

and an inclined first lower lane disposed below the first upper lane and configured to provide a lower movement path of the first play ball falling from the first lower end of the first upper lane. Here, the lower end of the first lower lane may be disposed at the location such that the first play ball falling from the lower end of the first lower lane passes through the first point of the track.

In an embodiment, the first lane assembly may further include a first lowering device configured to transport the first play ball falling from the first lower end of the first upper lane to the first lower lane.

In an embodiment, the first lowering device may include a screw-shaped first blade configured to roll down the first play ball.

In an embodiment, the elevating device may include: a rotary motor; a raising screw part having a rotary shaft rotated by the rotary motor and extending in a vertical direction, and having a threaded surface having an area, in which the first play ball entering through the first entrance is received; a fence part surrounding the raising screw part and extending in the vertical direction, and configured to prevent the first play ball rising along the threaded surface of the raising screw part from falling; and a conical exit guide part provided at an upper end of the raising screw part and having a shape that becomes larger as it goes to the upper side. Here, the first play ball making contact with a surface of the exit guide part may move toward the first exit such that the first play ball becomes farther away from the rotary shaft as the first play ball rises further due to the rotation of the raising screw part.

In an embodiment, the game apparatus may further include a first exit operating member disposed at a lower side of the exit guide part, and having a first outer end that is first-jointed to the fence part and a first inner end disposed to protrude from the fence part to the rotary shaft. Here, after the first play ball rising along the threaded surface of the raising screw part makes contact with a lower surface of the first inner end, the first play ball may push up the first inner end by using the first outer end as the center of rotation while the play ball rises. Also, the first play ball and the first exit operating member may be separated from each other before the first play ball makes contact with the exit guide part. Also, when the first play ball falls from the threaded surface of the raising screw part while making contact with the exit guide part and moving, the first play ball may move from the upper surface of the first inner end to the upper surface of the first outer end, and here, the height of the first inner end may be greater than the height of the first outer end.

In an embodiment, the first guard rail may be installed to be spaced apart from the base floor to the upper side to provide a passage, in which the play ball falling from the first lower end moves toward the elevating device when the play ball falling from the first lower end does not enter any one of the first set of cars. Here, a distance between the first guard rail and one side of the track in a direction of inner spaces of the respective cars may be shorter than a diameter of the play ball.

In an embodiment, the game apparatus may further include: a first play button; and a first feeder installed in the first upper lane and having an operating protrusion. Here, the first feeder may allow the operating protrusion to protrude from the first upper lane to the top such that the play ball does not move on the first upper lane depending on an input signal of the first play button, or allow the operating protrusion to move to the lower side of the first upper lane such that the play ball moves on the first upper lane.

In an embodiment, the game apparatus may further include: a first infrared sensor installed at the first point of the track; a second infrared sensor installed at the first point of the track; and a control unit. Here, the first infrared sensor may output a signal that varies whenever the respective cars of the first train device pass through the first point, the second infrared sensor may output different signals depending on whether the play ball is present on a bottom surface of the car passing through the first point, and the control unit may count changes in the signal output by the first infrared sensor to determine the order of the car passing through the first point, and to determine in which car of the first train device the play ball is present based on the signal output by the second infrared sensor and the determined order.

In an embodiment, the game apparatus may further include: a third infrared sensor installed at the third point of the track to detect whether the first train device is present at the third point; a fourth infrared sensor installed at the fourth point of the track to detect whether the first train device is present at the fourth point; a fifth infrared sensor installed at the fifth point of the first lane assembly to detect whether the play ball is present at the fifth point; a sixth infrared sensor installed at the sixth point of the first lane assembly to detect whether the play ball is present at the sixth point; and a control unit. Here, the control unit may determine: a third time point, at which a front end of the first train device reaches the third point based on an output signal of the third infrared sensor; a fourth time point, at which a front end of the first train device reaches the fourth point based on an output signal of the fourth infrared sensor; a fifth time point, at which the play ball reaches the fifth point based on an output signal of the fifth infrared sensor; a sixth time point, at which the play ball reaches the sixth point based on an output signal of the sixth infrared sensor; a velocity of the first train device based on the third time point and the fourth time point; and a velocity of the play ball based on the fifth time point and the sixth time point, and the control unit may control the velocity of the first train device based on the determined velocity of the play ball.

In an embodiment, the game apparatus may further include: a second lane assembly configured to provide a movement path of another play ball provided from a second exit disposed at the upper end of the elevating device; a second guard rail disposed to extend along the track in the inner space such that a first play ball placed on a first bottom surface of any one of the first set of cars is not separated from the first bottom surface; and a second opening disposed next to a first end, among both ends of the second guard rail, in a direction in which the first train device moves forwards, and configured to allow the first play ball to be separated from the first bottom surface and fall to the base floor. Here, the base floor may include a second slope configured to provide a path, in which the first play ball falling through the second opening rolls to a second entrance disposed at a lower end of the elevating device, the elevating device may raise the first play ball entering through the second entrance, and send out the play ball through the second exit, the first lane assembly and the second lane assembly may be disposed at locations that are opposite to each other with respect to the elevating device, the first guard rail and the second guard rail may be disposed at locations that are opposite to each other with respect to the elevating device, the first opening and the second opening may be disposed at locations that are opposite to each other with respect to the elevating device, the first exit and the second exit may be disposed at locations that are opposite to each other with respect to the elevating device, and a movement limiting fence that limits movement of the first play ball falling to the base floor may be installed between a first area including the first slope and a second area including the second slope of the base floor.

In an embodiment, the first exit and an upper end of the first lane assembly may be disposed at locations that are opposite to each other with respect to the elevating device. Here, the second exit and an upper end of the second lane assembly may be disposed at locations that are opposite to each other with respect to the elevating device, and the game apparatus may further include: a first spiral slide configured to connect the first exit and the upper end of the first lane assembly; and a second spiral slide configured to connect the second exit and the upper end of the second lane assembly.

In an embodiment, sizes of a first car and a second car in the first set of cars may be different.

According to the present invention a game apparatus can be provided using a train device and a play ball, which has own game scenario and a structure that allows two players to play games independently.

BRIEF DESCRIPTION OF THE DRAWINGS

FIG. 1 is a perspective view illustrating a game apparatus provided according to an embodiment;

FIG. 2 is a plan view illustrating some configuration including especially a base floor, a track, and a train device of the game apparatus illustrated in FIG. 1;

FIG. 3 is a perspective view illustrating a detailed configuration of an elevating device of the game apparatus illustrated in FIG. 1;

FIG. 4 is a perspective view illustrating a detailed configuration of a first lane assembly of the game apparatus illustrated in FIG. 1; a FIG. 5 is a perspective view illustrating a shape of respective cars included in a train device illustrated in FIG. 1;

FIG. 6 is a view illustrating a lower end of the elevating device in FIG. 1 in detail;

FIG. 7 is an exploded front view illustrating a configuration of an upper part of the elevating device illustrated in FIG. 1;

FIG. 8 is a perspective view illustrating the configuration of the upper part of the elevating device illustrated in FIG. 1;

FIG. 9 is a view illustrating a structure of a first upper lane constituting the first lane assembly illustrated in FIG. 1;

FIG. 10 is a view illustrating a part including a feeder of the first upper lane illustrated in FIG. 9 in detail;

FIG. 11 is a view illustrating a structure and a placement of a guard rail installed in the game apparatus illustrated in FIG. 1;

FIG. 12 is a plan view illustrating the train device and the guard rail of the game apparatus in FIG. 1 when viewed from top to bottom;

FIG. 13 is a view illustrating a shape of bottom surfaces of the respective cars of constituting the train device;

FIG. 14 is a view for explaining the location and the function of sensors installed in the track included in the game apparatus illustrated in FIG. 1; and FIG. 15 is a view illustrating a structure of the train device provided according to the embodiment.

DETAILED DESCRIPTION OF EMBODIMENTS

Hereinafter, embodiments of the present invention will be described with reference to the accompanying drawings. The present disclosure may not be limited to the embodiments explained in the specification and may be implemented in various different forms. Further, the terms used in the specification are for understanding of the technical contents, and the technical scope of the present invention is not limited thereto. In addition, singular forms used below include plural forms as long as the phrases do not clearly represent the opposite meaning.

FIG. 1 is a perspective view illustrating a game apparatus provided according to an embodiment.

The game apparatus 1 is an apparatus that may be operated by two players of the first player and the second player.

The game apparatus 1 according to the embodiment may include a base floor 10, an elevating device 100, a track 20, a first lane assembly 210, a second lane assembly 220, a first train device 310, a second train device 320, a first guard rail 31, a second guard rail 32, a first opening 41.*a* second opening 42, a housing 50, a first play button 61, a second play button 62, and one or more play balls 50.

The first train device 310 and the second train device 320 are devices in which several cars are connected to each other, respectively. The appearance of the first train device 310 and the second train device 320 may be similar to the appearance of a vehicle moving on rails, such as a steam locomotive, but not limited to that. That is, the appearance of the respective cars may be provided in various shapes such as a teacup shape and an UFO shape. The example given in the specification is the appearance of the respective cars, which is similar to the appearance of a train, such as a traditional steam locomotive.

The elevating device 100 may be installed to extend to be perpendicular to one point of the base floor 10. The one point may be a central portion of the base floor 10.

FIG. 2 is a plan view illustrating a partial configuration including especially a base floor, a track, and a train device of the game apparatus illustrated in FIG. 1.

Hereinafter, the present invention will be described with reference to FIGS. 1 and 2.

The track 20 may be disposed in a form of surrounding the central portion of the base floor 10, in which the elevating device 100 is installed. The track 20 may have a closed structure including a ring shaped chain circulating indefinitely. The ring shape may have a shape such as a circular shape, a rectangular shape, or a free-form shape. The track may extend along an edge of the base floor 10.

FIG. 3 is a perspective view illustrating a detailed configuration of an elevating device of the game apparatus illustrated in FIG. 1.

FIG. 4 is a perspective view illustrating a detailed configuration of a first lane assembly of the game apparatus illustrated in FIG. 1.

Hereinafter, the present invention will be described with reference to FIGS. 1, 3, and 4.

The first lane assembly 210 may provide a first movement path of the play ball 50 provided from a first exit 111 disposed at an upper end of the elevating device 100. The first movement path may be a first lane such that the a play ball 50 rolls or slides and moves from top to bottom.

Similarly, the first lane assembly 220 may provide a second movement path of the play ball 50 provided from a second exit 112 disposed at an upper end of the elevating device 100. The second movement path may be a second lane such that the play ball 50 rolls or slides and moves from top to bottom.

The play ball 50 may have a spherical shape or an arbitrary shape, which may move to slide along the first lane or the second lane.

The elevating device 100 may raise the play ball 50 introduced from a first entrance 101 or a second entrance 102 disposed at a lower end of the elevating device 100 through the elevating device 100. The raised play ball 50 may be discharged through the first exit 111 or the second exit 112 disposed at the upper end of the elevating device 100.

The play ball 50 discharged through the first exit 110 may be provided to an upper part of the first lane of the first lane assembly 210. A first lower end 2132, in which the play ball 50 moved downwards along the first lane assembly 210 may fall from the first lane assembly 210, may be disposed in the lower part of the first lane assembly 210. The first lower end 2132 may be substantially disposed directly above the track 20.

Similarly, the play ball 50 discharged through the second exit 120 may be provided to an upper part of the second lane of the second lane assembly 220. A second lower end, in which the play ball 50 moved downwards along the second lane assembly 220 may fall from the second lane assembly 220, may be disposed in the lower part of the first lane assembly 220. The second lower end may be substantially disposed directly above the track 20.

The first lane assembly 210 and the second lane assembly 220 may substantially have the same configuration and may be disposed at the locations that are opposite to each other with respect to the elevating device 100.

The first train device 310 and the second train device 320 may move along the track 20. The movement direction is counterclockwise or clockwise, and both a first train device 310 and a second train device 320 may move along the same direction.

The first train device 310 may include a first set of cars 311 that are a plurality of cars. The second train device 320 may include a second set of cars 321 that are a plurality of cars.

The first train device 310 and the second train device 320 may not be possessed exclusively by the first player or the second player.

FIG. 5 is a perspective view illustrating a shape of the respective cars included in a train device illustrated in FIG. 1. FIG. 5 illustrates a state when viewed outwards from the central portion of the game apparatus 1.

The upper sides 308 of the respective cars 311 and 321, which are included in the first train device 310 and the second train device 320, may be opened such that an arbitrary play ball 50 that is present in the game apparatus 1 enters the cars 311 and 321 to be disposed on the bottom surfaces of the cars 311 and 321.

Here, an arbitrary play ball 50 may fall downwards from the first lane assembly 210 or the second lane assembly 220.

Hereinafter, the present invention will be described with reference to FIG. 4 again.

As described above, the first lower end 2132 of the first lane assembly 210 may be disposed at a location such that the play ball 50 falling from the first lower end 2132 passes through a first location 21 of a first point of the track 20. Similarly, the second lower of the second lane assembly 220 may be disposed at a location such that the play ball falling from the second lower end passes through a second location of a second point of the track 20.

For the respective cars 311 and 321 included in the first train device 310 and the second train device 320, one side 307 facing the space in which the base floor 10 is disposed, that is, which is a space in the inner direction 306 of the track 20, may be opened such that the arbitrary play balls 50 located in the respective cars may move to the space in the inner direction 306, that is, which is in the X-axis direction illustrated in FIG. 5, through the one side 307.

The bottom surfaces 305 of respective cars included in the first train device 310 and the second train device 320 may be inclined to be lowered in the height as it moves toward the inner direction 306 such that the arbitrary play balls 50 located in the respective cars 311 and 321 may fall to roll or slide to the space in the inner direction 306 through the one side 307.

The first guard rail 31 may be a guard rail having a finite length, which is disposed to extend along the track 20 in the space in the inner direction 306, such that the play ball 50 placed on the bottom surfaces 305 of the arbitrary cars 311 and 321 included in the first train device 310 and the second train device 320 is not separated from the bottom surface 305. The shortest distance between the first guard rail 31 and the track 20 may be constantly maintained.

Similarly, the second guard rail 32 may be a guard rail having a finite length, which is disposed to extend along the track 20 in the space in the inner direction 306, such that the play ball 50 placed on the bottom surfaces 305 of the arbitrary cars 311 and 321 included in the first train device 310 and the second train device 320 is not separated from the bottom surfaces 305. The shortest distance between the second guard rail 32 and the track 20 may be constantly maintained.

The track 20 forms a closed curve, but the first guard rail 31 and the second guard rail 32 have finite lengths, respectively, and may be disposed in opposite locations with respect to the elevating device 100.

When the first train device 310 or the second train device 320 passes by the first guard rail 31 or the second guard rail 32, the play ball 50 is stopped by the first guard rail 31 or the second guard rail 32 before the play ball 50 included in the cars 311 and 321 of the first train device 310 or the second train device 320 rolls down from the bottom surface 305 and is separated from the cars 311 and 321. However, as soon as the first train device 310 or the second train device 320 passes through one end of the first guard rail 31 or the second guard rail 32, the play ball 50 stopped by the first guard rail 31 or the second guard rail 32 rolls down to the base floor 10.

In this way, the space of the location in which the play ball 50 stopped by the first guard rail 31 rolls down to the base floor 10 may be referred to as the first opening 41. In addition, the space of the location in which the play ball 50 stopped by the second guard rail 32 rolls down to the base floor 10 may be referred to as the second opening 42.

The first guard rail 31 may extend to at least the first location 21 of the first point of the track 20 along the opposite direction of a direction in which the first train device 310 or the second train device 320 progresses, from the location of the first opening 41. Similarly, the second guard rail 32 may extend to at least the second location of the second point of the track 20 along the opposite direction of a direction in which first train device 310 or the second train device 320 progresses, from the location of the second opening 42.

The first location and the second location may be opposite to each other with respect to the elevating device 100.

The first opening 41 is disposed next to one end, among both ends of the first guard rail 31, in a direction in which the first train device 310 or the second train device 320 moves forwards, and allows the play ball 50 to be separated from the bottom surface 305 and fall to the base floor 10.

Similarly, the second opening 42 is disposed next to one end, among both ends of the second guard rail 32, in a direction in which the first train device 310 or the second train device 320 moves forwards, and allows the play ball 50 to be separated from the bottom surface 305 and fall to the base floor 10.

The base floor 10 may include a first slope 11 providing a path, in which the play ball 50 falling from the first train device 310 or the second train device 320 through the first opening 41 rolls to the first entrance 101 disposed at the lower end of the elevating device 100.

Similarly, the base floor 10 may include a second slope 12 providing a path, in which the play ball 50 falling from the first train device 310 or the second train device 320 through the second opening 42 rolls to the second entrance 102 disposed at the lower end of the elevating device 100.

In order to provide the first slope 11 and the second slope 12, at least a part of the base floor 10 may have a recessed shape to the vertically lower side as the base floor goes toward the center thereof.

The elevating device 100 raises the play ball 50 entering through the first entrance 101 and releases the play ball through the first exit 111.

Similarly, the elevating device 100 raises the play ball 50 entering through the second entrance 102 and releases the play ball through the second exit 112.

Here, the play ball 50 entering through the first entrance 101 may be output through the first exit 111 but not be output through the second exit 112.

Similarly, the play ball 50 entering through the second entrance 102 may be output through the second exit 112 but not be output through the first exit 111.

FIG. 6 illustrates a lower end of the elevating device in FIG. 1 in detail.

Hereinafter, the present invention will be described with reference to FIGS. 3 and 6.

The elevating device 100 may include a rotary motor 120, a raising screw 130, a fence part 140, and an exit guide part 150.

The raising screw 130 may be rotated by the rotary motor 120. The raising screw 130 may have a shaft 132 extending in a vertical direction and may have a screw blade 131 having an area that can receive the play ball 50 entering through the first entrance 101 or the second entrance 102. The screw blade 131 may be integrally or separately installed on an outer circumferential surface of the shaft 132.

The rotary motor 120 may be disposed at the lower end of the elevating device 100 and may be hidden at the lower side of the base floor 10. The rotary motor 120 may be controlled to operate as long as one or more the play balls 50 are present in the elevating device 100.

Infrared sensors for detecting the presence of the play ball 50 entering the interior of the elevating device 100, may be installed around the first entrance 101 and the second entrance 102. In addition, infrared sensors for detecting the presence of the play ball 50 exiting from the elevating device 100, may be installed around the first exit 111 and the second exit 112.

The fence part 140 may surround the raising screw 130 and may extend along a vertical direction. The first entrance 101 may be disposed at a first side of a lower end of the fence part 140, and the second entrance 102 may be disposed at a second side of the lower end of the fence part 140.

The play ball 50 moved along the first slope 11 may enter the elevating device 100 through the first entrance 101, and the play ball 50 moved along the second slope 12 may enter the elevating device 100 through the second entrance 102.

FIG. 7 is an exploded front view illustrating a configuration of an upper part of the elevating device illustrated in FIG. 1.

FIG. 8 is a perspective view illustrating the configuration of the upper part of the elevating device illustrated in FIG. 1.

Hereinafter, the present invention will be described with reference to FIGS. 7 and 8.

The horizontal cross-section of the fence part 140 may have a shape that prevents the play ball 50 rising to be placed on the surface of the screw blade 131 of the fence part 140 rotating from falling outwards from the screw blade 131.

When the horizontal cross-section of the fence part 140 has a circular shape having the rotation center and the concentricity of the shaft 132, and the radius of the horizontal cross-section of the fence part 140 minus the radius of the shaft 132 is greater than the diameter of the play ball 50, the play ball 50 having a spherical shape may roll or slide on the surface of the screw blade 131 while rotating along the surface of the screw blade 131. In this case, the play ball 50 may not be raised by the raising screw 130. Accordingly, the horizontal cross-section of the fence part 140 may satisfy the following conditions.

That is, first of all, when the vertical extension direction of the elevating device 100 is called the Z-axis direction, the play ball 50 may enter the elevating device 100 through the first entrance 101 of coordinates (x1, y1) that is the location of the first entrance 101 on the X-Y plane, or the play ball 50 may enter the elevating device100 through the second entrance 102 of coordinates (x2, y2) that is the location of the second entrance 102 on the X-Y plane. Here, the horizontal cross-section of the fence part 140 may have shapes such that the play ball 50 entering through the coordinates (x1, y1) is substantially not separated from the coordinates (x1, y1) while rising. Similarly, the horizontal cross-section of the fence part 140 may have shapes such that the play ball 50 entering through the coordinates (x2, y2) is substantially not separated from the coordinates (x2, y2) while rising.

The exit guide part 150 may be disposed at the upper end of the raising screw 130. The exit guide part 150 is a conical member that narrows downwards and widens upward. The central axis of the exit guide part 150 is concentric with the central axis of the shaft 132.

The play ball 50 rises and eventually rises while making contact with the surface of the exit guide part 150. The play ball 50 rising while making contact with the surface 151 of the exit guide part 150, is moved outwards from the central axis of the raising screw 130. The play ball 50 gradually becomes farther away from the central axis of the raising screw 130, and is eventually separated from the raising screw 130 and falls toward the first exit 111.

A first exit operating member 161 and a second exit operating member 162 are disposed to be opposite to each other with respect to the raising screw 130 on the lower side of the exit guide part 150.

The first exit operating member 161 has a first inner end 1611 disposed to protrude from the fence part 140 toward the shaft 132 and a first joint unit 1612. The play ball 50 rising along the screw blade 131 of the raising screw 130, makes contact with a lower surface of the first inner end 1611. The force, by which the play ball 50 is raised, allows the first inner end 1611 to move to rotate upwards about the first joint unit 1612. Before the play ball 50 makes contact with the exit guide part 150, the play ball 50 is separated from the first inner end 1611. When the play ball 50 is separated from the first inner end 1611, the first inner end 1611 moves to rotate downwards about the first joint unit 1612. An upper surface of the first exit operating member 161 may maintain to be inclined in a downward direction from the central portion of the elevating device 100 while the first inner end 1611 and the play ball 50 do not make contact with each other. When the play ball 50 moves in contact with the exit guide part 150 and falls outwards from the screw blade 131, the play ball 50 moves outwards along the upper surface of the first exit operating member 161 and exits from the first exit 111.

Similarly, the second exit operating member 162 has a second inner end 1621 disposed to protrude from the fence part 140 toward the shaft 132 and a second joint unit 1622. The play ball 50 rising along the screw blade 131 of the raising screw 130, makes contact with a lower surface of the second inner end 1612. The force, by which the play ball 50 is raised, allows the second inner end 1621 to move to rotate upwards about the second joint unit 1622. Before the play ball 50 makes contact with the exit guide part 150, the play ball 50 is separated from the second inner end 1621. When the play ball 50 is separated from the second inner end 1621, the second inner end 1621 moves to rotate downwards about the second joint unit 1622. An upper surface of the second exit operating member 162 may maintain to be inclined in a downward direction from the central portion of the elevating device 100 while the second inner end 1621 and the play ball 50 do not make contact with each other. When the play ball 50 moves in contact with the exit guide part 150 and falls outwards from the screw blade 131, the play ball 50 moves outwards along the upper surface of the second exit operating member 162 and exits from the second exit 112.

The first exit operating member 161 may be regarded as the first exit 111 and the second exit operating member 162 may be regarded as the second exit 112.

The play ball 50 coming down along the upper surface of the first exit operating member 161 may be provided to an upper surface of a first upper end 1711 of a first spiral slide 171 disposed on the upper end of the elevating device 100. The play ball 50 moving along the upper surface of the first spiral slide 171 from the first upper end 1711 of the first spiral slide 1711 may reach a first outlet 1712 of the first spiral slide 171, and fall downwards through the first outlet 1712. The first upper end 1711 and the first outlet 1712 may be disposed at the locations that are opposite to each other with respect to the elevating device 100. The first upper end 1711 may be be disposed higher than the first outlet 1712.

A second spiral slide (not illustrated) may be made of the same configurations as the first spiral slide 171, and may be disposed to be opposite to the first spiral slide 171 with respect to the elevating device 100.

FIG. 9 illustrates a structure of a first upper lane constituting the first lane assembly illustrated in FIG. 1.

The play ball 50, which passes through the first outlet 1712 after being seated on the first upper end 1711 and falls downwards through the first outlet 1712, may be provided to an upper end 2111 of the first upper lane 2110 constituting the first lane assembly 210.

The first lane assembly 210 may include the first upper lane 2110, a first lowering device 2120, and a first lower lane 2130.

The first upper lane 2110 provides the upper movement path of the play ball 50.

The first upper lane 2110 is a lane inclined downwards from the upper end 2111 to the lower end 2112.

FIG. 10 illustrates a part including a feeder of the first upper lane illustrated in FIG. 9 in detail.

A first feeder 2113 including a first operating protrusion 2114 is installed around the lower end 2112 of the first upper lane 2110. The first feeder 2113 may be rotated by operating the first play button 61. Any one of the plurality of first operating protrusions 2114 may be maintained to protrude upwards from the bottom surface of the first upper lane 2110 while the first play button 61 is not pressed. The play ball 50 coming down along the first upper lane 2110 is blocked by any one of the first operating protrusions 2114 and may no longer progress downwards.

When the first play button 61 is pressed once, the first feeder 2113 may be rotated by a predetermined first angle. While the first feeder 2113 rotates by the first angle, any one of the first operating protrusions 2114, which protrudes, may be lowered below the bottom surface of the first upper lane 2110. Here, the play ball 50 blocked by any one of the first operating protrusions 2114, which protrudes, may be separated from the lower end 2112 of the first upper lane 2110 and may enter the interior of the first lowering device 2120.

While the first feeder 2113 rotates by the first angle, any one of the first operating protrusions 2114, which protrudes, may be lowered below the bottom surface of the first upper lane 2110, and another first operating protrusion 2114 may rise above the bottom surface of the first upper lane 2110 again to protrude. Another play ball 50 waiting on the first upper lane 2110 is not allowed to be separated into from the first upper lane 2110 by another first operating protrusion 2114 protruding.

Hereinafter, the present invention will be described with reference to FIG. 4 again.

The play ball 50 entering the first lowering device 2120 may fall at the upper end 2131 of the first lower lane 2130 along a path provided by the first lowering device 2120.

The first lower lane 2130 may be disposed in the lower side of the first lowering device 2120 and may provide the lower movement path of the play ball 50.

The path provided by the first lowering device 2120 may be designed to reduce a drop impact of the play ball 50 or to produce a drop scene of the play ball 50 in a specific way. For example, the first lowering device 2120 may include a screw type first blade 2121, in which the play ball 50 may roll down.

The play ball 50, which falls at the first upper end 2131 of the first lower lane 2130, may move to roll or slide along the first lower lane 2130 to reach the first lower end 2132 of the first lower lane 2130. The first lower lane 2130 may be inclined from the first upper end 2131 to the first lower end 2132.

The first lower end 2132 of the first lower lane 2130 may be disposed at a location such that the play ball 50 falling from the first lower end 2132 passes through a first location 21 of a first point of the track 20.

FIG. 11 illustrates a structure and a placement of a guard rail installed in the game apparatus illustrated in FIG. 1.

FIG. 11 illustrates a state viewed outwards from the central portion of the game apparatus 1.

FIG. 12 is a plan view illustrating the train device and the guard rail of the game apparatus in FIG. 1 when viewed from top to bottom.

Hereinafter, the present invention will be described with reference to FIGS. 11 and 12.

The first guard rail 31 may be installed on the base floor 10 or on the track 20.

The lower edge part 3101 of the first guard rail 31 may be installed such that the lower edge part is disposed to be spaced apart by H1 upwards from the base floor 10. Accordingly, this is to provide a passage, in which the play ball 50 falling from the first lower end 2132 may move on the base floor 10 to move toward the elevating device 100 when the play ball 50 falling from the first lower end 2132 of the first lower lane 2130 enters neither the first set of cars 311 nor the second set of cars 321.

The distance between the first guard rail 31 and the one side 307 of the inner direction 306 of the track 20 of the respective cars 311 and 321 may be shorter than the diameter of the play ball 50. This is to prevent the play ball 50, which is intended to deviate from the cars 311 and 321, from deviating to be stopped by the first guard rail 31.

The first set of cars 311 included in the first train device 310 may include cars having different widths. As illustrated in FIG. 12, the sizes of a first car 3111 and a second car 3112, which are included in the first train device 310, are different. Thus, the possibility of the play ball 50 entering the respective cars can be differently adjusted.

In the embodiment, the first car 3111 may be greater than the second car 3112. Here, when the play ball 50 is inserted into a smaller car, the score may be higher. When user succeeds in a high level of difficulty mission, he or she will be given a bigger reward.

FIG. 13 illustrates a shape of bottom surfaces of the respective cars constituting the train device.

The bottom surfaces 305 of the respective cars 311 and 321 may be inclined downwards toward the inner direction 306 such that the play ball 50 placed on the bottom surfaces 305 may roll or slide toward the inner direction 306.

FIG. 14 is a view for explaining the location and the function of sensors installed in the track included in the game apparatus illustrated in FIG. 1.

Hereinafter, the present invention will be described with reference to FIGS. 2 and 14.

A first infrared sensor 81 may be installed in the first point 810 of the track 20, and a second infrared sensor 82 may be installed in the upper part of the first point 810 of the track 20.

When the first train device 310 or the second train device 320 passes at the first point 810, the first infrared sensor 81 may be disposed at a lower location than the first train device 310 or the second train device 320, to radiate an infrared beam upwards.

When the first train device 310 or the second train device 320 passes at the first point 810, the second infrared sensor 82 may be disposed at a higher location than the first train device 310 or the second train device 320, to radiate an infrared beam downwards.

The first infrared sensor 81 may be to output a changed signal whenever the respective cars 311 and 321 of the first train device 310 or the second train device 320 passes through the first point 810.

The second infrared sensor 82 may be to output different signals depending on whether the play ball 50 is present on the bottom surfaces 305 of the cars 311 and 321 passing through the first point 810.

The game apparatus 1 may further include the control unit that is not illustrated. The control unit is a kind of computing device and may be installed to be disposed in any space inside or outside of the game apparatus 1.

The control unit counts changes in the signal output by the first infrared sensor 81 to determine the order in the first train device 310 of the first set of car 311 passing through the first point 810. Similarly, The control unit counts changes in the signal output by the first infrared sensor 81 to determine the order in the second train device 320 of the second set of car 321 passing through the first point 810.

In addition, the control unit determines in which car of the first train device 310 the play ball 50 is present, and determines in which car of the second guard rail 32 the play ball 50 is present based on the signal output by the second infrared sensor 82 and the determined order.

A third infrared sensor 83 may be installed at the third point 830 of the track 20 to detect whether the first train device 310 or the second train device 320 is present at the third point 830, and a fourth infrared sensor 84 may be installed at the fourth point 840 of the track 20 to detect whether the first train device 310 or the second train device 320 is present at the fourth point 840.

The control unit may determine a third time point, at which a front end of the first train device 310 or the second train device 320 reaches the third point 830 based on an output signal of the third infrared sensor 83, and may determine a fourth time point, at which a front end of the first train device 310 or the second train device 320 reaches the fourth point 840 based on an output signal of the fourth infrared sensor 84, Hereinafter, the present invention will be described with reference to FIG. 4.

A fifth infrared sensor 85 may be installed at the fifth point 850 of the first lane assembly 210 to detect whether the play ball 50 is present at the fifth point 850, and a sixth infrared sensor 86 may be installed at the sixth point 860 of the first lane assembly 210 to detect whether the play ball 50 is present at the sixth point 860.

The control unit may determine a fifth time point, at which the play ball 50 reaches the fifth point 850 based on an output signal of the fifth infrared sensor 85, and may determine a sixth time point, at which the play ball 50 reaches the sixth point 860 based on an output signal of the sixth infrared sensor 86.

Next, the control unit may determine the present velocity of the first train device 310 or the second train device 320 based on the third time point and the fourth time point, and may determine the present velocity of the play ball 50 based on an the fifth time point and sixth time point.

Next, the control unit may control the velocity of the first train device 310 or the second train device 320 based on the determined present velocity of the play ball 50.

FIG. 15 illustrates a structure of an operating device of the train device provided according to the embodiment.

A closed curve chain 25 may be installed on the track 20. The chain 25 may be rotated by receiving a driving force provided by a track driving motor 23 through a sprocket 24.

A suspension 312 extending downwards may be installed on the lower surface of the respective cars of the first train device 310. A wheel 313 that rolls while making contact with the track may be installed at the lower end of the suspension 312. The lower end of the suspension 312 may be fixedly coupled to a portion of the chain 25.

According to the above configuration, when the chain 25 rotates, the first train device 310 may rotate along the chain 25. The velocity of the first train device 310 may be eventually controlled by controlling the velocity of the track driving motor 23.

In addition, a wing part 314 extending outwards from the track may be installed at the lower end of the suspension 312. The two wing parts 314 installed in the two adjacent cars 311 may be spaced apart from each other. The first infrared sensor 81 explained in FIG. 14 may detect whether the wing parts 314 are present when the wing parts 314 pass over the first infrared sensor 81. Here, the first infrared sensor 81 may output, for example, a value of '1' when detecting the wing part 314, or a value of "0" when the wing part is not detected. Accordingly, when the train device does not pass above the first infrared sensor 81, a value of '0' may be always output, and when the train device passes above the first infrared sensor 81, a pulse train signal, which alternately repeats values of '0' and '1', may be output. The control unit may recognize when the pulse train signal starts and determine how many '1' signals have been generated from the starting point, and may now determine which of the train device is the car passing above the first infrared sensor 81.

Meanwhile, the second infrared sensor 82 explained in FIG. 14 is installed directly above the first infrared sensor 81. Here, when the second infrared sensor 82 confirms that the play ball 50 is loaded on a car passing under the second infrared sensor 82, it may be determined which of the train device is the car loaded with the play ball 50.

The reward score assigned to the respective cars of the train device may be predetermined. Accordingly, the number of car loaded with the play ball 50 may be determined and accordingly, it may give a player a score.

<Game Rules>

The game rules for using the game apparatus according to the present invention will be briefly described as follows.

A first player may press the first play button 61 once. Event signals generated from the first play button 61 may rotate the first feeder 2113 by a specific angle.

Before pressing the first play button 61, one operating protrusion 2114 present in the first feeder 2113 is maintained to protrude onto the movement path of the first upper lane 2110, and thus the play ball 50 in the first phase 2110 is prevented from moving below the first feeder 2113.

While the first play button 61 is pressed and the first feeder 2113 is rotated at a specific angle, one operating protrusion 2114 hides downwards in the movement path of the first upper lane 2110, at which point the play ball 50 moves below the first feeder 2113.

The play ball 50 moves below the first feeder 2113, and then another operating protrusion 2114 present in the first feeder 2113 protrudes over the movement path of the first upper lane 2110. The rotation of the first feeder 2113 stops when the another operating protrusion 2114 protrudes over the movement path of the first upper lane 2110. Here, the other play balls in the first upper lane 2110 does not move below the first feeder 2113 and waits due to the another operating protrusion 2114. The other play balls may only be moved when the first play button 61 is pressed again.

The play ball 50 moving below the first feeder 2113 is separated from the first upper lane 2110, and falls into the movement path provided by the first lower lane 2130 through the first lowering device. The play ball 50 moved through the movement path provided by the first lower lane 2130 falls toward the track 20 from the first lower end 2132 of the first lower lane 2130.

Here, when the first train device 310 or the second train device 320 pass at the lower side of the first lower end 2132, the play ball 50 falling toward the track 20 may enter any one of the cars 311 and 321 of the first train device 310 or the second train device 320.

When the play ball 50 falling toward the track 20 does not enter any cars 311 and 321, the play ball 50 falls to the base floor 10 through the space below the lower edge of the first guard rail 31.

When the play ball 50 falling toward the track 20 is assumed to enter, for example, the first car of the cars of the first train device 310, here, until the first train device 310 further moves forward and the first car reaches the first opening 41, the play ball 50 is blocked by the first guard rail 31 and is not separated from the first car. When the first car reaches the first opening 41, the play ball 50 exits from the first car through the first opening 41 of the play ball 50 and falls to the base floor 10.

Meanwhile, when the first train device 310 containing the play ball 50 passes through the first infrared sensor 81 and the first infrared sensor 82, the control unit may determine which car the first car containing the play ball 50 is present based on the outputs of the first infrared sensor 81 and the second infrared sensor 82. Depending on the results, the control unit may provide rewards to the first player. Rewards may be provided by visually outputting on the electronic display board or audibly outputting through the speaker installed in the game apparatus 1, or by discharging specific goods through a dispenser installed in the game apparatus 1.

The play ball 50 falling to the base floor 10 moves through the first slope 11, and enter the lower end of the elevating device 100 through the first entrance 101. The play ball 50 is raised to an upper part of the elevating device 100 by a rotating screw blade 131. The rising play ball 50 pushes up the first inner end 1611 of the first exit operating member 161 to reach the exit guide part 150. The play ball 50 continuously rising in contact with the exit guide part 150, is eventually pushed outwards from the raising screw 130 to fall, and rolls along the upper surface of the first exit operating member 161 to exit through the first exit 111. The play ball 50 exiting through the first exit 111 is supplied back to the first upper lane 2110 on the first spiral slide 171.

The second play button 62 may be provided for the second player on an opposite side to the first play button 61. A second component used by the second player may be the same as the first component used by the first player. The second component may be disposed at the location that is opposite to the first component with respect to the elevating device.

The base floor 10 and the elevating device 100 are components used jointly by the first and second players. In addition, all of the train devices moving within the game apparatus 1 are components used jointly by the first and second players. The train device may have one, two, three or more within the game apparatus 1.

According to the present invention, the game apparatus using the train device and the play ball has the structure that allows two players to play games independently with own game scenario.

According to the above-mentioned embodiment of the present invention, the present invention may be variously corrected and modified by those skilled in the art to which the present invention pertains without departing from the essential features of the present invention. The contents of each claim in the scope of the patent claim may be combined with another claim without a quoted relationship within the scope of that this statement can be understood through the specification.

What is claimed is:

1. A game apparatus comprising:

a base floor;

an elevating device installed at one point of the base floor;

a closed track disposed in a form of surrounding the elevating device;

a first lane assembly configured to provide a movement path of a play ball provided from a first exit disposed at an upper end of the elevating device;

a first train device configured to move in one direction along the track and comprising a first set of cars, wherein the upper side of each of the cars is open such that an arbitrary play ball enters into the each of the cars, and one side of the each of the cars is open towards an inner space of the track such that the arbitrary play ball exits from the each of the cars towards the inner space of the track, bottom surfaces of the each of the cars is inclined in the direction of the inner space, and a first lower end of the first lane assembly is disposed at a location such that the play ball falling from the first lower end passes through a first point over the track;

a first guard rail disposed to extend along the track in the inner space such that a first play ball placed on a first bottom surface of any one of the first set of cars is not separated from the first bottom surface; and a first opening disposed next to a first end among both ends of the first guard rail, and configured to allow the first play ball to be separated from the first bottom surface and fall to the base floor, wherein the base floor comprises a first slope configured to provide a path, in which the first play ball falling through the first opening rolls to a first entrance disposed at a lower end of the elevating device, and the elevating device is configured to raise the first play ball entering through the first entrance, and send out the first play ball through the first exit.

2. The game apparatus of claim 1, wherein the first lane assembly comprises:

an inclined first upper lane configured to provide an upper movement path of the first play ball; and an inclined first lower lane disposed below the first upper lane and configured to provide a lower movement path of the first play ball falling from a first lower end of the first upper lane, wherein the a lower end of the first lower lane is disposed at the location such that the first play ball falling from the lower end of the first lower lane passes through the first point over the track.

3. The game apparatus of claim 2, wherein the first lane assembly further comprises a first lowering device configured to transport the first play ball falling from the first lower end of the first upper lane to the first lower lane.

4. The game apparatus of claim 1, wherein the elevating device comprises:

a rotary motor;

a raising screw part having a rotary shaft rotated by the rotary motor and extending in a vertical direction, and having a threaded surface having an area, in which the first play ball entering through the first entrance is received;

a fence part surrounding the raising screw part and extending in the vertical direction, and configured to prevent the first play ball rising along the threaded surface of the raising screw part from falling; and a conical exit guide part provided at an upper end of the raising screw part and having a shape that becomes larger as it goes to the upper side, wherein the first play ball making contact with a surface of the exit guide part moves toward the first exit such that the first play ball becomes farther away from the rotary shaft as the first play ball rises further due to the rotation of the raising screw part.

5. The game apparatus of claim 4, further comprising a first exit operating member disposed at a lower side of the exit guide part, and having a first outer end that is first-jointed to the fence part and a first inner end disposed to protrude from the fence part to the rotary shaft, wherein, after the first play ball rising along the threaded surface of the raising screw part makes contact with a lower surface of the first inner end, the first play ball pushes up the first inner end by using the first outer end as the center of rotation while the play ball rises, wherein the first play ball and the first exit operating member are separated from each other before the first play ball makes contact with the exit guide part, wherein, when the first play ball falls from the threaded surface of the raising screw part while making contact with the exit guide part and moving, the first play ball moves from an upper surface of the first inner end to an upper surface of the first outer end, and here, the height of the first inner end is greater than the height of the first outer end.

6. The game apparatus of claim 1, wherein the first guard rail is installed to be spaced apart from the base floor to the upper side to provide a passage, in which the play ball falling from the first lower end moves toward the elevating device when the play ball falling from the first lower end does not enter any one of the first set of cars, wherein a distance between the first guard rail and one side of the track in a direction of inner spaces of the respective cars is shorter than a diameter of the play ball.

7. The game apparatus of claim 2, further comprising:

a first play button; and a first feeder installed in the first upper lane and having an operating protrusion, wherein the first feeder allows the operating protrusion to protrude from the first upper lane such that the play ball does not move on the first upper lane depending on an input signal of the first play button, or allows the operating protrusion to move to a lower side of the first upper lane such that the play ball moves on the first upper lane.

8. The game apparatus of claim 1, further comprising:

a first infrared sensor installed at the first point of the track;

a second infrared sensor installed at the first point of the track; and a control unit, wherein the first infrared sensor outputs a signal that varies whenever the respective cars of the first train device pass through the first point, wherein the second infrared sensor outputs different signals depending on whether the play ball is present on a bottom surface of the car passing through the first point, wherein the control unit counts changes in the signal output by the first infrared sensor to determine the order of the car passing through the first point, and to determine in which car of the first train device the play ball is present based on the signal output by the second infrared sensor and the determined order.

9. The game apparatus of claim 1, further comprising:

a third infrared sensor installed at the third point of the track to detect whether the first train device is present at a third point;

a fourth infrared sensor installed at the fourth point of the track to detect whether the first train device is present at a fourth point;

a fifth infrared sensor installed at the fifth point of the first lane assembly to detect whether the play ball is present at a fifth point;

a sixth infrared sensor installed at a sixth point of the first lane assembly to detect whether the play ball is present at the sixth point; and a control unit, wherein the control unit is configured to:

determine a third time point, at which a front end of the first train device reaches the third point based on an output signal of the third infrared sensor;

determine a fourth time point, at which a front end of the first train device reaches the fourth point based on an output signal of the fourth infrared sensor;

determine a fifth time point, at which the play ball reaches the fifth point based on an output signal of the fifth infrared sensor;

determine a sixth time point, at which the play ball reaches the sixth point based on an output signal of the sixth infrared sensor;

determine a velocity of the first train device based on the third time point and the fourth time point;

determine a velocity of the play ball based on the fifth time point and the sixth time point; and control the velocity of the first train device based on the determined velocity of the play ball.

10. The game apparatus of claim 1, further comprising:

a second lane assembly configured to provide a movement path of another play ball provided from a second exit disposed at the upper end of the elevating device;

a second guard rail disposed to extend along the track in the inner space such that a first play ball placed on a first bottom surface of any one of the first set of cars is not separated from the first bottom surface; and a second opening disposed next to a first end, among both ends of the second guard rail, in a direction in which the first train device moves forwards, and configured to allow the first play ball to be separated from the first bottom surface and fall to the base floor, wherein the base floor comprises a second slope configured to provide a path, in which the first play ball falling through the second opening rolls to a second entrance disposed at a lower end of the elevating device, wherein the elevating device raises the first play ball entering through the second entrance, and sends out the play ball through the second exit, wherein the first lane assembly and the second lane assembly are disposed at locations that are opposite to each other with respect to the elevating device, wherein the first guard rail and the second guard rail are disposed at locations that are opposite to each other with respect to the elevating device, wherein the first opening and the second opening are disposed at locations that are opposite to each other with respect to the elevating device, wherein the first exit and the second exit are disposed at locations that are opposite to each other with respect to the elevating device, wherein a movement limiting fence configured to limit movement of the first play ball falling to the base floor is installed between a first area comprising the first slope and a second area comprising the second slope of the base floor.

11. The game apparatus of claim 10, wherein the first exit and an upper end of the first lane assembly are disposed at locations that are opposite to each other with respect to the elevating device, and wherein the second exit and an upper end of the second lane assembly are disposed at locations that are opposite to each other with respect to the elevating device, wherein the game apparatus further comprises:

a first spiral slide configured to connect the first exit and the upper end of the first lane assembly; and a second spiral slide configured to connect the second exit and the upper end of the second lane assembly.

12. The game apparatus of claim 1, wherein sizes of a first car and a second car in the first set of cars are different.

* * * * *